United States Patent [19]

Burke

[11] Patent Number: 4,931,102

[45] Date of Patent: Jun. 5, 1990

[54] METAL CLEANING PROCESS

[75] Inventor: John M. Burke, Kirtland, Ohio

[73] Assignee: Eaton Corporation, Cleveland, Ohio

[21] Appl. No.: 239,255

[22] Filed: Sep. 1, 1988

[51] Int. Cl.[5] ..... B05D 5/00

[52] U.S. Cl. ..... 134/2; 134/7; 134/29; 29/DIG. 7; 51/295; 427/444

[58] Field of Search ..... 134/2, 7, 26, 29; 29/DIG. 7; 51/295; 427/327, 404, 444, 419.1; 148/DIG. 17

[56] References Cited

U.S. PATENT DOCUMENTS

| | | | |
|---|---|---|---|
| 1,523,373 | 2/1925 | Cleveland | 134/29 |
| 2,032,174 | 2/1936 | Johnson | 134/29 |
| 4,432,808 | 2/1984 | Heubusch | 134/3 |
| 4,528,039 | 7/1985 | Rubin et al. | 134/29 X |
| 4,540,444 | 9/1985 | Kelly | 134/3 |
| 4,552,783 | 11/1985 | Stoll et al. | 134/2 X |
| 4,590,100 | 5/1986 | Hearst | 134/29 X |
| 4,654,089 | 5/1987 | Singelyn et al. | 134/29 X |
| 4,752,411 | 6/1988 | Melin et al. | 134/29 X |

FOREIGN PATENT DOCUMENTS

| | | |
|---|---|---|
| 0127064 | 5/1984 | European Pat. Off. . |

*Primary Examiner*—Patrick P. Garvin
*Assistant Examiner*—George R. Fourson
*Attorney, Agent, or Firm*—A. E. Chrow

[57] ABSTRACT

Processes are provided for cleaning metal in preparation for painting, coating, welding or other subsequent process. The processes all include rinsing the metal with a solution of deionized water and a water soluble amine having a vapor pressure of at least about 10% of the vapor pressure of water at 20° C. resulting in an essentially residue and water spot free surface promoting welding and bonding of the paint or coating thereto as well as enhancing other subsequent processes that may be scheduled therefore.

32 Claims, 2 Drawing Sheets

METAL CLEANING PROCESS

INTRODUCTION

This invention relates generally to a process for cleaning metal and more particularly to a process that utilizes a alkaline soap and water solution, deionized water, and a mixture of morpholine and deionized water, for cleaning metal that is particularly advantageous for cleaning metal in preparation for adhering a wear resistant material such as titanium nitride thereto or for cleaning an engine component such as a valve in preparation for adhering a coating such as an aluminum coating thereto.

BACKGROUND OF THE INVENTION

Heretofore it has been common practice to use chlorinated solvents such as trichlorethylene, perchloroethylene, 1,1,1-trichloroethane, methylene chloride and trichlorotrifluorethane and mixtures of trichlorotrifluoroethane with substances such as toluol, surfactants, alcohols such as methyl alcohol and inhibitors for removing oil and oil-like contaminants from metal. Although effective for cleaning metal, such solvents present significant toxicological and environmental problems in their storage, use and discard.

Non-chlorinated solvents such as alcohols, toluol, methyl ethyl ketone, mineral spirits and kerosene have also been used in the past to remove oil and oil-like contaminants from metal but likewise present significant toxicological, storage and environmental problems as well as flammability and explosion problems in their storage, use and discard. Both chlorinated and non-chlorinated solvents characteristically are unable to effectively remove carbonaceous soils and water spots from metal surfaces.

Water-based cleaners have also been employed for many years for cleaning metal parts. But such cleaners characteristically have not been as effective a cleaner as the solvents previously described and tend to leave, or are designed to leave residue deposits on the metal surfaces which inhibit painting, welding and/or effective bonding of other materials to the metal surface. Or, if the surface is sufficiently clean for painting or bonding and the like, corrosion such as rust on ferrous metal parts can occur in seconds which may, in some cases, render the part useless.

Due to the tendency of water to promote corrosion, corrosion inhibitors such as sodium or potassium sulfonates, sodium nitrite, or barium napthiate are commonly added to water and cleaners. Such inhibitors are characteristically of a residue type that provide a polar or non-polar film on the surface being cleaned to prevent oxygen from attacking the surface but which also can be detrimental to subsequent processes on the surface such as painting, welding or the bonding of wear resistant and coatings such as titanium nitride.

There has therefore existed a need to provide a process for removing oil and oil-like contaminants from metal that is water-based and does not employ chlorinated or non-chlorinated solvents such as previously described yet which is capable of providing an essentially residue free surface as well as minimizing or preventing rusting of ferrous metals at least for a time sufficient to enable some subsequent process scheduled therefore.

It has been discovered that such process can be provided where the metal part is washed with an alkaline soap and water solution and rinsed with both deionized water and a mixture of deionized water and morpholine prior to drying according to prescribed schedules.

Although it is known that deionized water is corrosive to ferrous metal, it has been discovered that such can be employed to advantage in the process of the invention by controlling the exposure time of the metal part to the deionized water and that by doing so water spots are essentially eliminated in rinsing processes using deionized water whereas such is characteristically not the case with ordinary tap water which may, by leaving residue deposits, interfere with welding and/or effective adherance of coatings to the metal surface.

Contrary to the teaching of the prior art, it has been discovered that dilute morpholine—deionized water solutions are not corrosive to metal and that evaporating the solutions at about 200° F. does not leave a residue deposit which could interfer with subsequent coating processes.

Aqueous amine solutions, such as a morpholine-water solutions, have been used in the past for passivating steel in preparation for application of non-aqueous protective coatings. An example of such is disclosed in U.S. Pat. No. 4,590,100, the disclosure of which is incorporated herein by reference. The morpholine however is mixed with ordinary water which would tend to water spot and the amine is chosen primarily to provide reaction sites that would chemically bond to selected materials used for the coating. Another example of a use of morpholine for rectifying chlorinated hydrocarbon deposits on copper is disclosed in U.S. Pat. No. 4,080,393, the disclosure of which is incorporated herein by reference. Again however the morpholine is mixed with ordinary water which is also used for rinsing which would promote water spotting which is a detrimental to welding and/or bonding many materials to the metal surfaces.

According to the "Encyclopedia of Chemical Technology", John Wiley and Sons, Volumes 2 and 21 (1983), morpholine is classified as an industrial solvent that is slightly toxic, requiring large amounts be taken orally to be serious and, in undiluted form, is irritating to the skin and breathing fumes in closed places should be avoided. Morpholine is classified as being infinitely soluble in water and is known chemically as either tetrahydro-1, 4 oxazine or diethyleneimide oxide having an aromatic ring structure with nitrogen and oxygen in two of the carbon positions.

In view of such, the use of deionized water, morpholine and deionized water, and alkaline soap and water solutions in prescribed schedules has been found to remove oil and oil-like contaminants as well as other contaminants soluble therein from ferrous and non-ferrous metal surfaces that are essentially residue and water spot free and which is particularly advantageous for preparing metal surfaces for welding and/or to which coating(s) are to be adhered.

SUMMARY OF THE INVENTION

Accordingly, it is an object of this invention to provide a process for cleaning metal.

It is another object of this invention to provide a process for cleaning metal that is highly effective in providing essentially residue and water-spot free surfaces while controlling rust and corrosion.

It is still another object of this invention to provide a process for cleaning metal that is operative to prepare a surface on the metal for welding and/or to which materials can be effectively adhered.

DESCRIPTION OF SOME PREFERRED EMBODIMENTS

Figure 1:
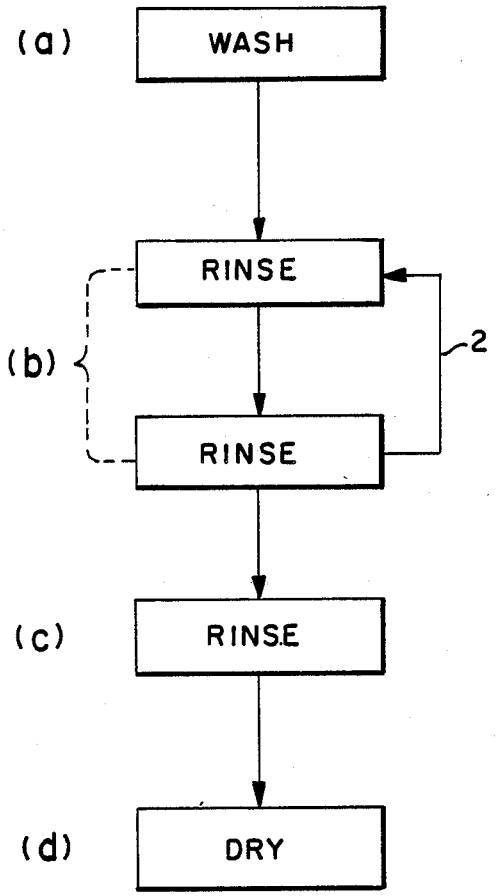
FIG. 1 is a block diagram of one embodiment of the process of the invention.

The process of the invention shown in FIG. 1 is particularly advantageous for cleaning metal parts that are lightly coated with oil and oil-like materials and other substances that are soluble in the materials employed in the process hereinafter described.

In step (a), the metal part is washed in an alkaline soap and water solution where alkaline soap characteristically includes one or more of tri-sodium phosphate, sodium meta-silicate, sodium tri-polyphosphate, sodium carbonate, potassium carbonate, sodium gluconate, 2-butoxyethanol and non-ionic surfactants and the like well known to those skilled in the art and may further include additives such as sodium hydroxide or potassium hydroxide where increased alkalinity is desired. Such soaps can be either ionic or non-ionic or mixtures of both and may include surface active agents such as sodium lauryl ether sulfonate, ackylaryl sulfonate triethanolamine, ackylaryle ether polygycol, and sodium citrate in an alkaline medium such as caustic potash. One alkaline soap found to be of particular advantage for cleaning ferrous metals is sold under the Tradename ISW-29 by Dubois Chemical and another for cleaning non-ferrous metal is sold under the trade number 422 by Dubois Chemical.

Although various ratios between the water and alkaline soap may be employed provided the resultant is alkaline, a ratio of about three (3) parts of the alkaline soap to about 100 parts of the water is preferred for the solution.

The solution of step (a) is preferably at a temperature of from about 100° F. to about 180° F. and the time of washing the metal part with the solution is preferably from about one minute to about six minutes. Any suitable method of washing the metal part with the washing solution of step (a) may be employed including dipping, spraying, tumbling or placing the metal part and solution in an agitated or ultra-sonic bath with spraying being preferred.

After washing the metal part with the solution of step (a), the metal part is then rinsed, preferably by dipping or spraying at least once, and preferably twice in step (b) with deionized water preferably having a purity commonly characterized in terms of volume resistivity which, for the present invention, is a volume resistivity of at least about $10^5$ ohm-cm at 25° C. and more preferably from about $10^5$ to about $10^6$ ohm-cm at 25° C. As described above, step (b) preferably comprises two separate rinses and even more preferably includes means for transferring the deionized rinse water from the second rinse to the first rinse at a predetermined rate which in effect is a type of counter-flow system and which tends to keep the second rinse from building up concentrations of the contaminants being removed from the metal. The temperature of the deionized water rinse is preferably from about 100° F. to about 140° F. and the time period of rinse is preferably from about 10 seconds to about four minutes whilst endeavoring to keep the metal part wetted between rinses and with minimal exposure to air which might promote flash rusting where the metal is ferrous or corrosion where the metal is non-ferrous such as aluminum.

After step (b), the metal part is then rinsed in a mixture of deionized water-soluble amine having a vapor pressure operative to enable the water and the amine to evaporate at about the same rate from the surface being cleaned and being further characterized by leaving the surface virtually residue free after having evaporated.

One such water-soluable amine found to be particularly advantageous is previously described morpholine which has a vapor pressure of about 6.6 mm of mercury compared to about 17.35 mm of mercury for water at 20° C. (68° F.). Morpholine and water likewise have similar boiling points of 128.9° C. and 100° C. respectively. Such is of great advantage during oven drying where morpholine evaporation lags slightly behind water at a given temperature enabling the morpholine vapors to surround and provide a corrosion protective evnironment about the metal part.

Water-soluble hydroxy amines having respective vapor pressures and boiling points substantially dissimilar to water however are not suitable for use in the process of the invention.. Such amines include ethanolamine (B.P.=170° C.; Vp=0.36 mm mercury at 20° C.); diethanolamine (Bp.=217° C.; Vp−0.01 mm mercury at 20° C.); and triethanolamine (Bp=277° C.; vp=0.01 mm mercury at 20° C.) Such amines evaporate much slower than morpholine and water and are prone to leave residue deposits that are apt to interfer with subsequent processes such as coating, welding, or painting scheduled for the part being cleaned.

Water-soluble amines suitable for use in the process of the invention are defined by having a vapor pressure of at least about 10% of the vapor pressure of water at 20° C. and by providing a virtually residue free surface after having evaporated from the surface.

With morpholine (preferably technical grade morpholine) being the preferred water-soluble amine for the process of the invention, the process is hereinafter illustratively described in conjunction with the use thereof so that after step (b), the metal part is rinsed with a mixture of morpholine and deionized water preferably of the same quality as previously described for the deionized water rinse.

Although larger amounts of morpholine may be used, the morpholine solution preferably comprises from about 0.1% to about 1.0% of and more preferably about 0.5% by weight to the total weight of the mixture and the mixture is preferably at a temperature of from about 70° F. to about 140° F.

After the morpholine-water rinse of step (c), the metal part (preferably while still wet) is then dried either as a finished part or a part upon a surface scheduled for welding and/or to which a material is to be adhered such as for example where the metal part is a cutting tool and the material is titanium nitride or the part is an engine valve scheduled to be aluminized.

Although lower drying temperatures may be used in step (d), the metal part is preferably dried by either heating it in an oven preferably to a temperature of at least about 180° F. or by blowing heated air at it preferably at a velocity of from about 2 to 20 feet per second at a temperature of preferably from about 190° F. to about 230° F. and more preferably at about 200° F. particularly for parts having voids, crevices, and otherwise complex complications.

As previously described, it is preferable to keep the metal part wetted between the steps of the process with minimal exposure time to air so as to prevent flash rusting when the metal part is ferrous.

Figure 2:
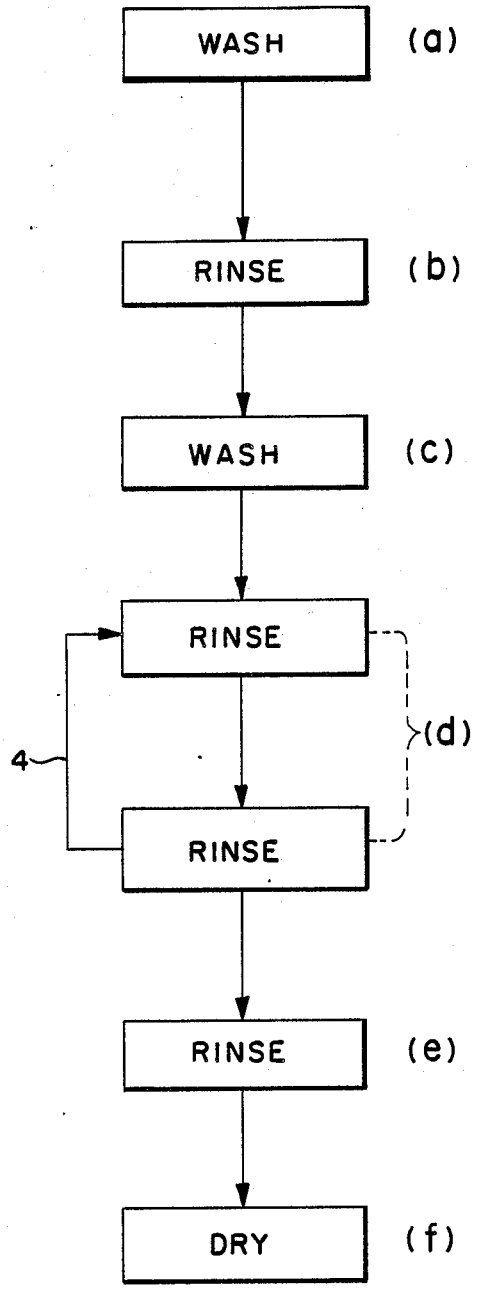
FIG. 2 is a block diagram of another embodiment of the process of the invention.

The embodiment of the process of the invention shown in FIG. 2 can be used to advantage where the metal is contaminated with moderate to heavy amounts of oil or oil-like deposits or with materials that are soluble in the materials herein described employed in the various steps of the process of the invention.

In the process of FIG. 2, wash step (a) is the same as previously described for step (a) of the process of FIG. 1 utilizing the alkaline soap and water solution preferably at a temperature of from about 100° F. to about 180° F. with which the metal is washed preferably for a time period of from about one minute to about six minutes.

After step (a), the metal is then washed with water which may either be ordinary tap water preferably having a hardness of less than about 8 grains per gallon and a pH of at least about 7 or by deionized water as previously described.

After step (b), the metal part is then washed in step (c) in an alkaline soap and water solution as described for step (a) of the process of FIGS. 1 and 2 but which preferably has a lower alkalinity which has been found to be advantageously provided by mixing from about one to about four ounces of an alkaline soap sold under the tradename "Super Terj" or "ISW-24" by Dubois Chemical with each gallon of water.

The solution of step (c) like that of step (a) is preferably at a temperature of about 100° F. and the metal is washed preferably for a time period of about one minute to about six minutes.

After step (c), the metal is rinsed (preferably twice) in step (d) in deionized water of the quality hereinbefore described for the deionized water of step (b) of the process of FIG. 1. The deionized water is preferably at a temperature of from about 100° F. to about 140° F. and counter-flow such as through a conduit from the second rinse into the first rinse at a predetermined rate may be employed as previously described for step (b) of the process of FIG. 1.

After step (d), the metal part is then rinsed in step (e) in the morpholine and deionized water mixture previously described for step (c) of the process of FIG. 1 which mixture is preferably at a temperature of from about 70° F. to about 140° F.

After step (e) the metal part is then dried in step (f) preferably by either heating the metal to a temperature of at least 180° F. or by exposing the metal to moving air heated to a temperature of from about 190° F. to about 230° F.

Figure 3:
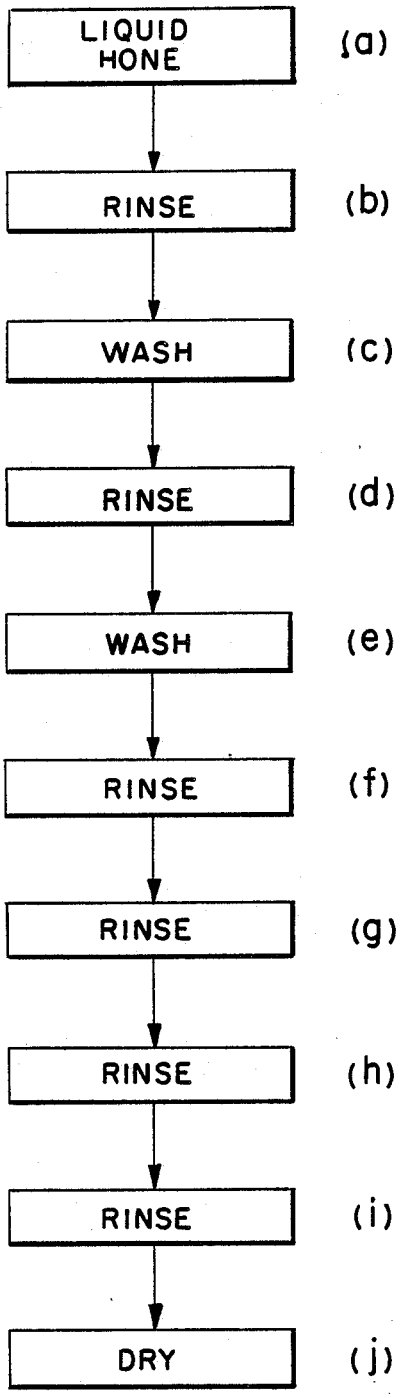
FIG. 3 is a block diagram of yet another embodiment of the invention.

The process of the invention shown in FIG. 3 is advantageous for cleaning extremely soiled metal parts that are contaminated with oil or oil-like materials or other materials that are soluble or dispensible in the materials employed in the steps of the process of the invention.

In the process of FIG. 3, the metal part is first honed in step (a) with an abrasive containing liquid. An example of a liquid honing material found to be highly effective for removing surface residues, varnishes, and carbonacious soils such as graphite, is a mixture of silicon dioxide abradant and alkaline soap and water. Preferably the silicone dioxide is about a 5000 mesh (3 micron) and is mixed at about one pound for ten gallons of water which may be deionized water of the quality herein described or tap water preferably having a hardness of less then about 8 grams per gallon as previously described. The alkaline soap is mixed into the water at about one ounce per gallon of water. A particularly effective alkaline soap has been found to be previously described "Super Terj" sold by Dubois Chemical.

The honing liquid is preferably sprayed against the metal at a spray pressure of about 100 psi and the temperature of the honing liquid is preferably at a temperature of from about 70° F. to about 100° F. The time of honing is dependent upon the soil load on the metal. The mesh size of the abradant is preferably greater than about 1000 for lower mesh sizes may impart a matt finish to the metal and mesh sizes at or near 5000 characteristically do not tend to cause dulling of sharpened tool edges being cleaned by the process of the invention.

After step (a), the metal is rinsed in step (b) with water which may be deionized water of the quality hereinbefore described.

After step (b), the metal part is washed in step (c) with the alkaline soap and water solution hereinbefore described for step (a) of the process of FIG. 1 and steps (a) and (c) of the process of FIG. 2. Accordingly, the solution is preferably at a temperature of from about 100° F. to about 180° F. and the washing time is preferably for a time period of a about one minute to about six minutes.

After step (c), the metal is then rinsed in step (d) with water which may be deionized water such as described for step (b).

After step (d), the metal is again washed in step (e) with the alkaline soap and water solution described for step (c).

After step (e), the metal is rinsed in step (f) with water as previously described for step (d).

After step (f), the metal is rinsed in step (g) with the morpholine and deionized water mixture previously described for step (c) of the process of FIG. 1 and for step (e) of the process of FIG. 2 where the mixture is preferably at a temperature of from about 70° F. to about 140° F.

After step (g), the metal is rinsed (preferably flood rinsed) with deionized water in step (h) as previously described for step (b) of the process of FIG. 1 and for step (d) of the process of FIG. 2 where the deionized water is preferably at a temperature of from about 100° F. to about 140° F. and the time of rinsing is preferably from about 10 seconds to about four minutes.

In step (i) the metal is rinsed with the morpholine and deionized water mixture previously described for step (g) and for step (e) of the process of FIG. 2 and step (c) of the process of FIG. 1. The mixture, as previously described, comprises a predetermined amount by weight of morpholine and deionized water having a volume resistivity of at least about $10^5$ ohm-cm at 25° C. which weight is preferably from about 0.1% to about 1.0% by weight of the mixture which is preferably at a temperature of from about 70° F. to about 140° F.

In step (j) the metal is dried for use either as a finished part or in preparation for some subsequent operation on the part as the case may be. As previously described, the drying is preferably done by either heating the metal to a temperature of about 180° F. or exposing the metal to a moving stream of air heated to a temperature of from about 190° F. to about 230° F.

The process of the invention is most advantageous for cleaning ferrous tool steel surfaces in preparation for receiving a coating of wear resistant material such as titanium nitride well known to those skilled in the art.

By use of the process of the present invention it has been found that the metal surfaces are essentially residue and water spot free and enable effective welding and/or bonding between the surface and a coating.

In the case of ferrous metal, and particularly ferrous tool steel, care should be taken as to the amount of time after cleaning that the coating or layer is applied for such metals are subject to flash rusting which would diminish its quality for some subsequent operation thereupon.

By way of example, the Process of the Invention shown in FIG. 1 and previously described was utilized in preparing freshly ground engine valves for spray coating with liquid aluminum whilst being heated to a temperature of about 400° F. The use of a 0.25% by weight ethanolamine and deionized water solution in step (c) resulted in 30% rejects due to residue deposits on the valves preventing bonding of the aluminum whereas the use of trichlorethylene or a mixture of about 0.25% by weight morpholine and deionized water in step (c) resulted in no rejects. During this same process, the morpholine was omitted from step (c) leaving only the dionized water as the rinse. The result was flash corrosion to the valve surfaces resulting in 100% rejects underlining the surprising effect of relatively low quantities of morpholine in the rinse of step (c).

By way of yet another example, the process of the invention herein described with respect to FIG. 2 was utilized in preparing M-2 high speed machining steel for a coating of titanium nitride in which tap water was inadvertantly used in the rinse of step (e) and resulted in water spotting that prevented the titanium nitride from bonding to the steel. Replacing the tap water with deionized water resulted in complete bonding of the titanium nitride to the steel.

What is claimed is:

1. A process for cleaning metal in preparation for adhering a wear resistant material thereto, said process including the steps of:

(a) washing the metal in an alkaline soap and water solution;

(b) rinsing the metal resulting from step (a) at least once with deionized water having a volume resistivity of at least about $10^5$ ohm-cm at 25° C.;

(c) rinsing the metal resulting from step (b) with a mixture of deionized water having a volume resistivity of at least about $10^5$ ohm-cm at 25° C. and a water soluble amine having a vapor pressure of at least about 10% of the vapor pressure of water at 20° C.; and (d) drying the metal resulting from step (c).

2. The process of claim 1 whereas the water-soluble amine is morpholine.

3. The process of claim 2 wherein the morpholine comprises from about 0.1% to about 1.0% by weight of the total weight of the mixture of step (c).

4. The process of claim 1 wherein step (b) further includes an additional rinse.

5. The process of claim 4 wherein the deionized water of the additional rinse is transferred into the first rinse.

6. A process for cleaning metal in preparation for adhering a wear resistant material thereto, said process including the steps of:

(a) washing the metal with an alkaline soap and water solution at a temperature of from about 100° F. to about 180° F.;

(b) rinsing the metal resulting from step (a) at least once with deionized water having a volume resistivity of at least about $10^5$ ohm-cm at a temperature of from about 100° F. to about 140° F.;

(c) rinsing the metal resulting from step (b) with a mixture by weight of about 0.1% to about 1.0% morpholine and deionized water having a volume resistivity of about $10^5$ to about $10^6$ ohm-cm at 25° C. at a temperature of from about 70° F. to about 140° F.; and (d) drying the metal resulting from step (c).

7. The process of claim 6 wherein the metal of step (b) is rinsed twice with the deionized water.

8. The process of claim 7 wherein the deionized water of the second rinse is transferred into the first rinse.

9. A process for cleaning metal in preparation for adhering a wear resistant material thereto, said process including the steps of:

(a) washing the metal with an alkaline soap and water solution;

(b) rinsing the metal resulting from step (a) with water;

(c) washing the metal resulting from step (b) with an alkaline soap and water solution;

(d) rinsing the metal resulting from step (c) at least once with deionized water having a volume resistivity of at least about $10^5$ ohm-cm at 25° C.;

(e) rinsing the metal resulting from step (d) with a mixture of deionized water having a volume resistivity of at least about $10^5$ ohm-cm at 25° C. and a water soluble amine having a vapor pressure of at least about 10% of the vapor pressure of water at 20° C.; and (f) drying the metal resulting from step (e).

10. The process of claim 9 where the water-soluble amine of step (e) is morpholine.

11. The process of claim 10 wherein the morpholine comprises from about 0.1% to about 1.0% by weight of the total weight of the mixture of step (e).

12. The process of claim 10 wherein step (d) further includes an additional rinse with the deionized water.

13. The process of claim 12 wherein the deionized water of the additional rinse is transferred into the first rinse.

14. The process of claim 9 wherein the alkalinity of the solution of step (c) is less than the alkalinity of the solution of step (a).

15. A process for cleaning metal in preparation for adhering a wear resistant material thereto, said process including the steps of:

(a) washing the metal with an alkaline soap and water solution having a prescribed alkalinity at a temperature of from about 100° F. to about 180° F.;

(b) rinsing the metal resulting from step (a) with water;

(c) washing the metal resulting from step (b) in an alkaline soap and water solution having an alkalinity less than the alkalinity of the solution of step (a) at a temperature of from about 100° F. to about 180° F.;

(d) rinsing the metal resulting from step (c) at least once with deionized water having a volume resistivity of at least about $10^5$ ohm-cm at 25° C. at a temperature of from about 100° F. to about 140° F.;

(e) rinsing the metal resulting from step (d) with a mixture of from about 0.1% to about 1.0% morpholine and deionized water having a volume resistivity of from about $10^5$ to about $10^6$ ohm-cm at 25° C. at a temperature of from about 70° F. to about 140° F.; and (f) drying the metal resulting from step (e).

16. The process of claim 15 wherein in preparation for adhering a wear resistant material thereto with the deionized water.

17. The process of claim 16 wherein the deionized water of the additional rinse is transferred into the first rinse.

18. A process for cleaning metal in preparation for adhering a wear resistant material thereto, said process including the steps of:

(a) honing the metal with an abrasive containing liquid;

(b) rinsing the metal resulting from step (a) with water;

(c) washing the metal resulting from step (b) with an alkaline soap and water solution;

(d) rinsing the metal resulting from step (c) with water;

(e) washing the metal resulting from step (d) with an alkaline soap and water solution;

(f) rinsing the metal resulting from step (e) with water;

(g) rinsing the metal resulting from step (f) with a mixture of deionized water having a volume resistivity of at least about $10^5$ ohm-cm at 25° C. and a water soluble amine having a vapor pressure of at least about 10% of the vapor pressure of water at 20° C.;

(h) rinsing the metal resulting from step (g) with deionized water having a volume resistivity of at least about $10^5$ ohm-cm at 25° C.;

(i) rinsing the metal resulting from step (h) with a mixture of deionized water having a volume resistivity of at least about $10^5$ ohm-cm at 25° C. and a water soluble amine having a vapor pressure of at least about 10% of the vapor pressure of water at 20° C.; and (j) drying the metal resulting from step (i).

19. The process of claim 18 wherein the abrasive containing liquid of step (a) comprises a mixture of an alkaline soap, an abrasive, and water.

20. The process of claim 18 or 19 wherein the abrasive is silicon dioxide.

21. The process of claim 18 or 19 wherein the abrasive of step (a) has a mesh size of at least about 1000.

22. The process of claim 18 or 19 wherein the abrasive of step (a) has a mesh size of about 5000.

23. The process of claim 19 wherein the water in the abrasive containing liquid is deionized water.

24. The process of claim 18 wherein the honing of step (a) is provided by spraying the metal with the abrasive containing liquid under pressure.

25. The process of claim 18 wherein the solution of step (e) has a lower alkalinity than the alkalinity of the solution of step (c).

26. The process of claim 18 whereas the water-soluble amine of steps (g) and (i) is morpholine.

27. The process of claim 26 wherein the morpholine comprises about 0.1% to about 1.0% by weight of the total weight of the mixture.

28. The process of claim 18 wherein the water of at least one of steps (b), (d), and (f) is deionized water.

29. The process of claim 28 wherein the deionized water has a volume resistivity of at least about $10^5$ ohm-cm at 25° C.

30. A process for cleaning metal in preparation for adhering wear resistant material thereto, said process including the steps of:

(a) honing the metal with an abrasive containing liquid;

(b) rinsing the metal resulting from step (a) with water;

(c) washing the metal resulting from step (b) with an alkaline soap and water solution at a temperature of from about 100° F. to about 180° F.;

(d) rinsing the metal resulting from step (c) with water;

(e) washing the metal resulting from step (d) with an alkaline soap and water solution having a lower alkalinity than the alkalinity of the solution of step (c) at a temperature of from about 100° F. to about 180° F.;

(f) rinsing the metal resulting from step (e) with water;

(g) rinsing the metal resulting from step (f) with a mixture comprising from about 0.1% to about 1% by weight morpholine and water at a temperature of from about 70° to about 140° F.;

(h) rinsing the metal resulting from step (g) with deionized water having a volume resistivity of at least about $10^5$ ohm-cm at 25° F. at a temperature of from about 100° F. to about 140° F.;

(i) rinsing the metal resulting from step (h) with a mixture comprising from about 0.1% to about 1% by weight morpholine and deionized water having a volume resistivity of at least about $10^5$ ohm-cm at 25° C. at a temperature of from about 70° F. to about 140° F.; and (j) drying the metal resulting from step (i).

31. The process of claims 1, 6, 9, 15, 18 or 30 wherein the metal is a metal cutting tool and the cleaning is in preparation for adhering a wear resistant material thereto.

32. The process of claim 31 wherein the material is titanium nitride.

* * * * *